US007851717B2

(12) United States Patent
Tatehata et al.

(10) Patent No.: US 7,851,717 B2
(45) Date of Patent: Dec. 14, 2010

(54) LIGHT-GUIDE SHEET, MOVABLE CONTACT UNIT AND SWITCH USING THE SAME

(75) Inventors: Naoki Tatehata, Kyoto (JP); Yousuke Chikahisa, Hyogo (JP); Tsutomu Aisaka, Osaka (JP); Koji Tanabe, Osaka (JP); Hirotoshi Watanabe, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/349,038

(22) Filed: Jan. 6, 2009

(65) Prior Publication Data

US 2009/0173608 A1 Jul. 9, 2009

(30) Foreign Application Priority Data

Jan. 7, 2008 (JP) ..... 2008-000333
Oct. 14, 2008 (JP) ..... 2008-265053

(51) Int. Cl.
*H01H 9/00* (2006.01)

(52) U.S. Cl. ..... 200/311; 362/293

(58) Field of Classification Search ..... 200/310, 200/311, 313; 362/293
See application file for complete search history.

(56) References Cited

U.S. PATENT DOCUMENTS

| | | | | |
|---|---|---|---|---|
| 5,881,201 | A * | 3/1999 | Khanarian | 385/146 |
| 6,217,184 | B1 * | 4/2001 | Koike et al. | 362/606 |
| 6,345,899 | B1 * | 2/2002 | Ohkawa et al. | 362/611 |
| 2007/0039809 | A1 | 2/2007 | Aihara et al. | |

FOREIGN PATENT DOCUMENTS

| | | |
|---|---|---|
| JP | 2007-87749 | 4/2007 |
| JP | 2008-071735 | 3/2008 |
| KR | 10-0765883 | 10/2007 |

* cited by examiner

*Primary Examiner*—Ross N Gushi
(74) *Attorney, Agent, or Firm*—Wenderoth, Lind & Ponack, LLP.

(57) ABSTRACT

A light-guide sheet includes a light transmissive film substrate, and luminescent protrusions formed at predetermined points on the substrate. At least one of the substrate and each of the luminescent protrusions is colored to a color tone that absorbs yellow light more than blue light. Alternatively, a reflective layer colored to a color tone that absorbs yellow light more than blue light is provided on at least one of the top and bottom faces of the substrate.

15 Claims, 6 Drawing Sheets

LIGHT-GUIDE SHEET, MOVABLE CONTACT UNIT AND SWITCH USING THE SAME

BACKGROUND OF THE INVENTION

1. Field of the Invention

The present invention relates to a light-guide sheet used mainly for operating electronic devices, and a movable contact unit and a switch employing the light-guide sheet.

2. Background Art

Recent electronic devices, typically mobile information terminals such as mobile phones, increasingly adopt light-emitting diodes or electroluminescent (EL) elements for lighting their control panels. This is to facilitate the identification and operation of buttons and display sheets, even in the dark. Movable contact units and switches that can be illuminated for easier visibility are also in demand for use in these devices.

A conventional movable contact unit and a switch are described next with reference to FIG. 11. FIG. 11 is a sectional view of the conventional switch. To facilitate understanding of the structure, dimensions are partially enlarged in FIG. 11. This switch includes movable contact unit 56, wiring board 57, light-emitting element 59, and display sheet 60.

Movable contact unit 56 includes light-guide sheet 53, film cover sheet 54, and substantially dome-shaped movable contacts 55 each made of a thin metal sheet. Light-guide sheet 53 includes light-transmissive film substrate 51, and luminescent protrusions 52 provided at predetermined points on the bottom face of substrate 51. Predetermined portions of the outer periphery of cover sheet 54 are attached to the bottom face of light-guide sheet 53 with adhesive (not illustrated). Movable contacts 55 are attached to the bottom face of cover sheet 54 under luminescent protrusions 52. Light-emitting element 59 such as a light-emitting diode is mounted on a top face of wiring board 57 at the right of light-guide sheet 53. The light-emitting face of light-emitting element 59 is faced toward a side face at the right end of light-guide sheet 53. FIG. 12 is a graph illustrating the relationship between optical wavelength and transmittance of light-guide sheet 53.

Wiring patterns (not illustrated) are formed on the top and bottom faces of wiring board 57. In particular, fixed contacts 58 are provided on the top face of wiring board 57. Each of fixed contacts 58 includes substantially round central fixed contact 58A and substantially U-shaped or ring-shaped outer fixed contact 58B around central fixed contact 58A. Movable contact unit 56 is attached to the top face of wiring board 57 such that the outer periphery of each movable contact 55 is placed on outer fixed contact 58B, and the center of the bottom face of movable contact 55 faces central fixed contact 58A with a predetermined distance in between.

Light-transmissive film display sheet 60 includes light-shielding portion 60A and display portions 60B. Display portions 60B are formed by cutting out the shape of the characters, symbols, etc., typically printed on the bottom face of display sheet 60. Display portions 60B are disposed over luminescent protrusions 52 of light-guide sheet 53.

The switch as configured above is placed on an operating face (not illustrated) of the electronic device. Central fixed contact 58A, outer fixed contact 58B, and light-emitting element 59 are connected to an electronic circuit (not illustrated) of the electronic device via wiring patterns.

In the above structure, when a user presses one of display portions 60B in display sheet 60, light-guide sheet 53 and cover sheet 54 dent, and a dome-like center of movable contact 55 is pressed. When a predetermined pressing force is applied to this center, movable contact 55 resiliently inverts downward with a click feeling, bringing the center of the bottom face of movable contact 55 down into contact with central fixed contact 58A. This contact electrically connects central fixed contact 58A and outer fixed contact 58B via movable contact 55.

When the pressing force on display sheet 60 is released, movable contact 55 resiliently reverts upward due to its resilient recovery force, separating the center of the bottom face of movable contact 55 from central fixed contact 58A. Accordingly, central fixed contact 58A and outer fixed contact 58B are electrically disconnected.

As described above, the device is switched to each function by electrical connection and disconnection of fixed contact 58. When power is supplied to light-emitting element 59 from the electronic circuit of the device, light-emitting element 59 emits light. This light enters light-guide sheet 53 from the side face at the right end, and propagates through leftward, causing a reflection in substrate 51.

The light is diffused and reflected in luminescent protrusions 52, and lights display portions 60B from beneath. Since display portions 60B are lighted, the user can identify the indications on display portions 60B, such as characters or symbols, even if the surrounding area is dark. The user can thus operate the device with ease.

For lighting display portions 60B by illuminating luminescent protrusions 52 of light-guide sheet 53, a white light is typically used as luminescent color of light-emitting element 59. White light is generally produced by mixing blue light and yellow light. As shown in FIG. 12, yellow light, which has a long wavelength, has high light-transmittance inside light-guide sheet 53, unlike blue light which has a short wavelength and low light-transmittance. Accordingly, if a small number of light-emitting elements 59, such as one or two, are used for lighting, luminescent protrusion 52 disposed near light-emitting element 59 produces white light of a mixture of blue and yellow. However, at luminescent protrusion 52 far from light-emitting element 59, blue light which has low transmittance weakens, and yellow light which has high transmittance is relatively intensified. As a result, the luminescent color of luminescent protrusion 52 at this point becomes yellowish. Illumination of display portions 60B thus results in uneven colors.

To prevent variations in luminescent colors of luminescent protrusions 52, and to uniformly illuminate display portions 60B, one way is to dispose numerous light-emitting elements 59 on the outer periphery of light-guide sheet 53. However, this results in a complicated and expensive structure.

SUMMARY OF THE INVENTION

The present invention offers a light-guide sheet that produces uniform luminescent color and provides readily visible and uniform lighting; and a movable contact unit and switch that employ this light-guide sheet. The light-guide sheet of the present invention includes a light-transmissive film substrate, and luminescent protrusions formed at predetermined points on the substrate. At least one of the substrate and each of the luminescent protrusions is colored to a color tone that absorbs yellow light more than blue light. Alternatively, a reflective layer colored to a color tone that absorbs yellow light more than blue light is provided on at least one of the top and bottom faces of the substrate. With either of the above structures, luminescent protrusions at points far from the light-emitting element can also be illuminated in a color tone identical to that of luminescent protrusions near the light-emitting element. Accordingly, variations in luminescent colors can be suppressed, achieving readily visible and uniform lighting.

DETAILED DESCRIPTION OF THE INVENTION

Figure 1:
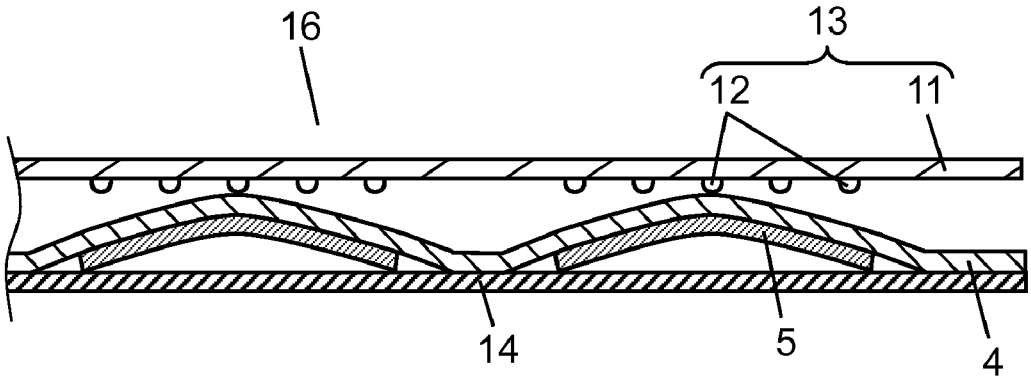
FIG. 1 is a sectional view of a movable contact unit employing a light-guide sheet in accordance with a first exemplary embodiment of the present invention.

Exemplary embodiments of the present invention are described below with reference to the drawings. To facilitate understanding of each structure, dimensions are partially enlarged in the drawings. In the respective embodiments, elements similar to those in a previous embodiment have the same reference marks as those in the previous embodiment, and detailed descriptions thereof are omitted.

First Exemplary Embodiment

Figure 2:
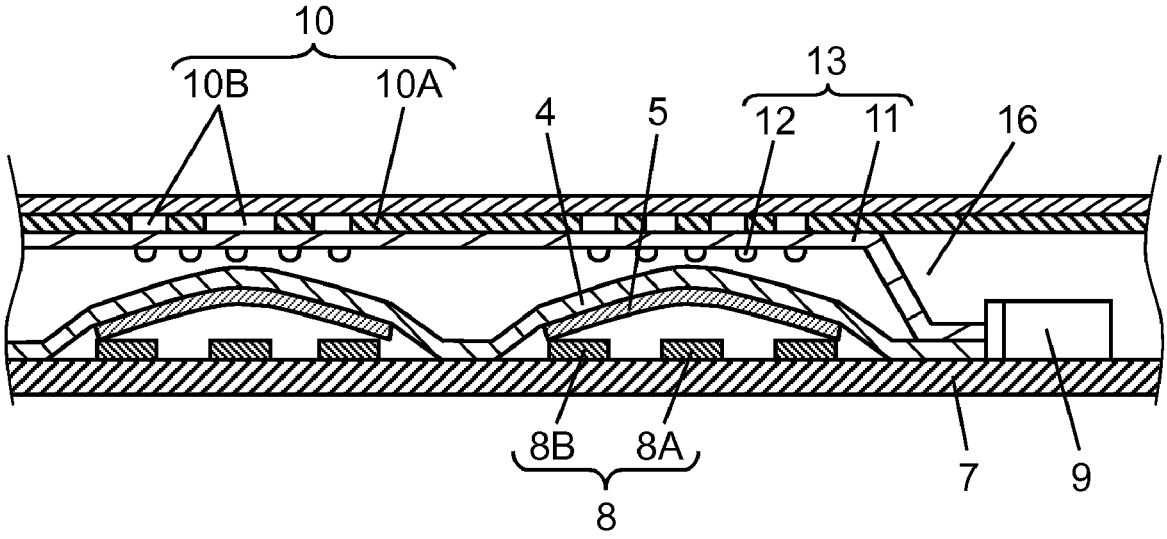
FIG. 2 is a sectional view of a switch employing a movable contact unit shown in FIG. 1.
Figure 3:
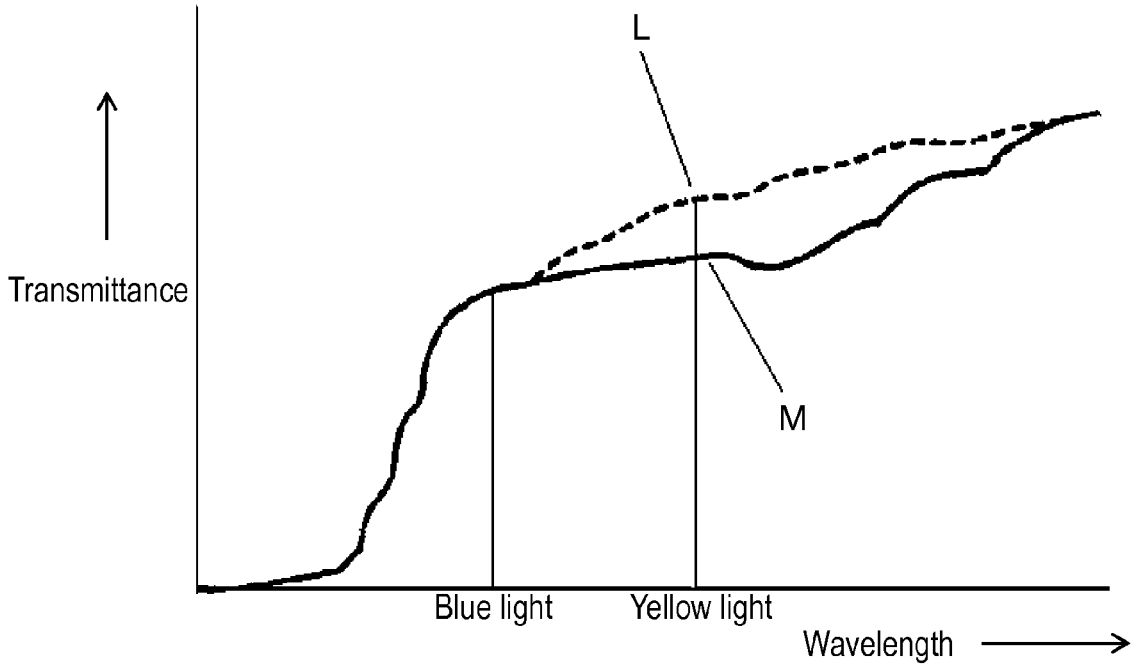
FIG. 3 is a graph illustrating the relationship between a wavelength and transmittance of the light-guide sheet shown in FIG. 1 and a light-guide sheet with a conventional structure.
Figure 4:
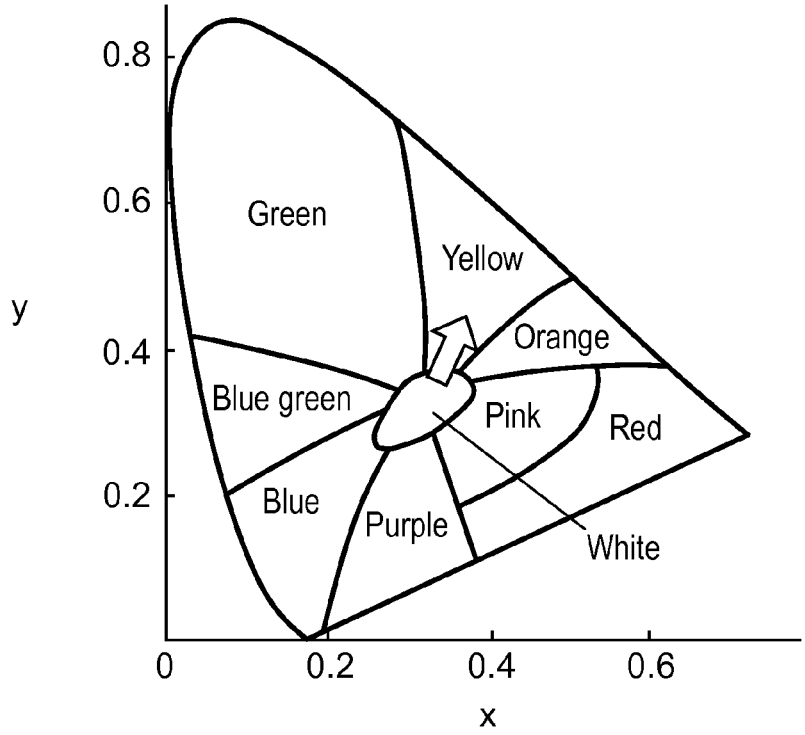
FIG. 4 is an x-y color diagram of CIE1931XYZ color system.

FIG. 1 is a sectional view of a movable contact unit employing a light-guide sheet in the first exemplary embodiment of the present invention. FIG. 2 is a sectional view of a switch employing the movable contact unit shown in FIG. 1. FIG. 3 is a graph illustrating the relationship between a wavelength and transmittance of the light-guide sheet shown in FIG. 1 and a conventional light-guide sheet. FIG. 4 is an x-y color diagram of CIE1931XYZ color system.

As shown in FIGS. 1 and 2, movable contact unit 16 includes light-guide sheet 13, film cover sheet 4, and dome-like resilient movable contact 5 made of a thin metal sheet. Light-guide sheet 13 includes light-transmissive film substrate 11 and luminescent protrusions 12 provided at predetermined points on the bottom face of substrate 11.

Substrate 11 is configured with light-transmissive polyurethane, silicone resin, polystyrene, and the like, and is flexible. Dye or pigment, such as phthalocyanine, indigo, anthraquinone, and iron blue, is dispersed in substrate 11 so as to color substrate 11 to a blue tone, which is a complementary color of yellow. Luminescent protrusions 12 are made of white or milky white resin such as polyester and epoxy, and are formed in dots typically by printing or the like.

The outer periphery of cover sheet 4 is attached to the bottom face of light-guide sheet 13 by adhesive (not illustrated) at predetermined points. Movable contacts 5 are attached to the bottom face of cover sheet 4 beneath luminescent protrusions 12. Light-emitting element 9, such as a light-emitting diode, is mounted on the top face of wiring board 7 at the right of light-guide sheet 13, and its light-emitting face is disposed toward a side face at the right end of light-guide sheet 13.

Movable contact unit 16 is stored and transported in the state that film separator 14 is attached to movable contact unit 16, as shown in FIG. 1. Separator 14 is configured with polyethylene terephthalate, and is attached such that it covers the entire bottom face of cover sheet 4. This prevents attachment of dust on the bottom face of movable contact 5 during storage and transportation.

Film-like or plate-like wiring board 7 is configured with a film typically of polyethylene terephthalate or polycarbonate, or plate typically of paper phenol or glass epoxy. Wiring patterns (not illustrated) are formed on the top and bottom faces of wiring board 7. In particular, fixed contacts 8 are provided on the top face, using copper, carbon, and the like as shown in FIG. 2. Each of fixed contacts 8 includes substantially round central fixed contact 8A and substantially U-shaped or ring-shaped outer fixed contact 8B surrounding central fixed contact 8A. Movable contact unit 16 after separator 14 is peeled off is attached to the top face of wiring board 7. The outer periphery of each of movable contacts 5 is placed on the outer fixed contact 8B, and the bottom center of movable contact 5 faces central fixed contact 8A with a predetermined distance in between.

Light-transmissive film display sheet 10 includes light-shielding portion 10A and display portions 10B. Display portions 10B are formed by cutting out the shape of the characters or symbols, etc., typically printed on the bottom face of display sheet 10. Display portions 10B are disposed over luminescent protrusions 12 of light-guide sheet 13.

The switch as configured above is attached to an operating face (not illustrated) of an electronic device. Central fixed contact 8A, outer fixed contact 8B, and light-emitting element 9 are connected to an electronic circuit (not illustrated) of the device typically via wiring patterns.

In the above structure, when the user presses one of display portions 10B in display sheet 10, light-guide sheet 13 and cover sheet 4 dent, and a dome-like center of movable contact 5 is pressed. When a predetermined pressing force is applied to this center, movable contact 5 resiliently inverts downward with a click feeling, bringing the center of the bottom face of movable contact 5 down into contact with central fixed contact 8A. This contact electrically connects central fixed contact 8A and outer fixed contact 8B via movable contact 5.

When the pressing force on display sheet 10 is released, movable contact 5 resiliently reverts upward due to its resilient recovery force, separating the center of the bottom face of movable contact 5 from central fixed contact 8A. Accordingly, central fixed contact 8A and outer fixed contact 8B are thus electrically disconnected.

As described above, the device is switched to each function by electrical connection and disconnection of fixed contact 8. When power is supplied to light-emitting element 9 from the electronic circuit of the device, light-emitting element 9 emits light. This light enters light-guide sheet 13 from a side face at the right end, and propagates through leftward, while being reflected in substrate 11.

This light is diffused and reflected in luminescent protrusions 12, and illuminates display portions 10B from beneath. Since display portions 10B are lighted, the user can identify the indications on display portions 10B, such as characters and symbols, even if the surrounding area is dark. The user can thus operate the device with ease.

As described above, pigment or dye is dispersed in substrate 11 of light-guide sheet 13, so as to color substrate 11 to a blue tone, which is a complementary color of yellow and absorbs yellow. Accordingly, luminescent protrusions 12 far from light-emitting element 9 are also illuminated in a color tone same as that of luminescent protrusions 12 near light-emitting element 9. This eliminates variations in luminescent colors, and provides readily visible and uniform lighting for display portions 10B.

When display portions 10B are lighted by illuminating luminescent protrusions 12 of light-guide sheet 13, white light is typically used as a luminescent color of light-emitting element 9. White light is generally produced by mixing blue light and yellow light. As shown by broken line L in a graph in FIG. 3, yellow light which has a long wavelength has a high light-transmittance, unlike blue light which has a short wavelength and low light transmittance when an uncolored light-guide sheet is used. Accordingly, if a small number of light-emitting elements 9, such as one or two, are used for illumination, luminescent protrusion 12 disposed near light-emitting element 9 produces white light of a mixture of blue and yellow. However, at luminescent protrusion 12 far from light-emitting element 9, yellow which has relatively high transmittance, is relatively intensified since blue which has low transmittance is weakened.

Outer length of a light-guide sheet is often around 3 to 15 cm, which is the range of sizes used for mobile phones. If an uncolored light-guide sheet is used, a luminescent color of luminescent protrusions 12 far from light-emitting element 9 has x and y components of +0.03 to +0.2 increased from white color, compared to luminescent protrusions 12 near light-emitting element 9. Accordingly, the luminescent color becomes yellowish.

Contrarily, the use of light-guide sheet 13 whose substrate 11 is colored to bluish, a complementary color of yellow, enables absorption of yellow light by substrate 11. Accordingly, transmittance of yellow light becomes almost the same as that of blue light, as shown by bold line M in FIG. 3. More specifically, changes in x and y components in a color diagram shown in FIG. 4 become around −0.03 to +0.03. Accordingly, luminescent protrusions 12 far from light-emitting element 9 also illuminate in white light with almost no color difference from white light of luminescent protrusions 12 near light-emitting element 19.

As described above, a yellow component in luminescent protrusions 12 at points far from light-emitting element 9 is absorbed by the blue color of substrate 11 as the light reflects and propagates through substrate 11. Therefore, no yellowish luminescent color, in which blue is weakened or yellow is intensified, may be produced. In addition, luminescent protrusions 12 near light-emitting element 9 illuminate in white as they are, with almost no influence of blue color of substrate 11. Since luminescent protrusions 12 far from light-emitting element 9 and luminescent protrusions 12 near light-emitting element 9 are both illuminated in the same white, display portions 10B can be lighted with uniform luminescent color.

By coloring substrate 11 with bluish color, which is a complementary color of yellow and absorbs yellow, luminescent protrusions 12 can be uniformly illuminated even if only a small number of light-emitting elements 9, such as one or two, are used for lighting. In other words, there is no need to dispose many light-emitting elements 9 in the outer periphery of light-guide sheet 13. Accordingly, variations in luminescent colors can be prevented with an inexpensive structure, and display portions 10B can be satisfactorily lighted.

If an uncolored substrate is used, x and y components change by around 0.04 to 0.10 when luminescent protrusion 12 is 4 to 6 cm away from light-emitting element 9. Furthermore, if luminescent protrusion 12 is 10 cm away from light-emitting element 9, x and y components change by around 0.10 to 0.17. On the other hand, if blue-colored substrate 11 is used, changes in x and y components remain around 0.002 to 0.011 even if luminescent protrusion 12 is 4 to 6 cm away from light-emitting element 9. Furthermore, even if luminescent protrusion 12 is 10 cm away from light-emitting element 9, changes in x and y components still remain around 0.005 to 0.018. Accordingly, luminescent protrusions 12 aligned in a line can be uniformly lighted by one light-emitting element 9 if the outer length of light-guide sheet 12 is around the size mentioned above.

As a material to be dispersed in substrate 11 for coloring substrate 11 to blue tone, aforementioned dyes are preferable. A dispersed amount is $0.1\times10^{-4}$ weight percent to $3\times10^{-4}$ weight percent. Preferably, the dispersed amount is $0.3\times10^{-4}$ weight percent to $1.5\times10^{-4}$ weight percent. In the description, "blue tone" is a color tone that absorbs yellow light more than blue light. It absorbs yellow light more than blue light in a luminescent spectral component by light-emitting element 9. The "blue tone" may thus be a color tone slightly different from blue.

It is preferable that substrate 11 is made of a soft material with small elastic modulus, such as polyurethane, silicone, and polystyrene as described above. By using such materials, a click feeling of movable contact 5 does not degrade on pressing movable contact 5 via light-guide sheet 13, in addition to providing uniform lighting. Accordingly, the user can gain a preferable tactile feeling in the operation.

For example, by the use of a soft material with elastic modulus of 1000 MPa or below, degradation in this click feeling can be prevented, and the user can gain a preferable tactile feeling in the operation. On the other hand, if a hard material with elastic modulus of 1500 MPa or above is used for substrate 11, a click feeling of movable contact 5 on pressing movable contact 5 via substrate 11 may degrade by any means. This type of material includes polycarbonate which has elastic modulus of about 2200 MPa, and polyethylene terephthalate which has elastic modulus of about 3000 MPa. To gain a satisfactory tactile feeling in operation, a soft material with elastic modulus of 1 MPa to 200 MPa, or further with elastic modulus of 1 MPa to 50 MPa is preferable.

Second Exemplary Embodiment

Figure 5:
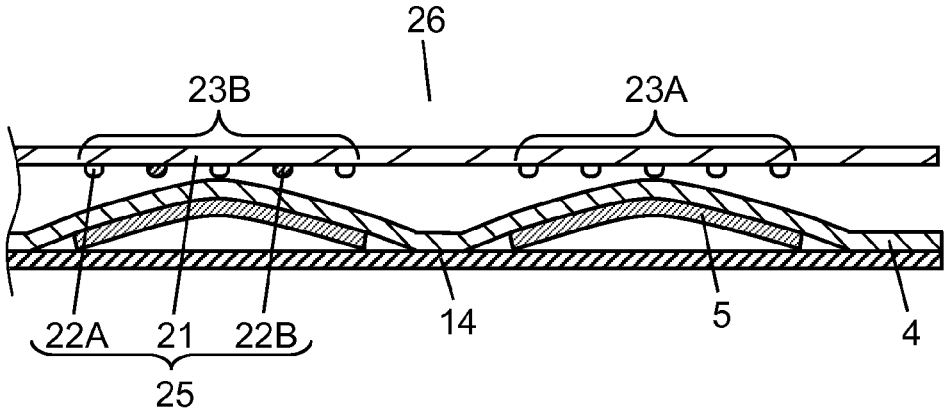
FIG. 5 is a sectional view of a movable contact unit employing a light-guide sheet in accordance with a second exemplary embodiment of the present invention.
Figure 6:
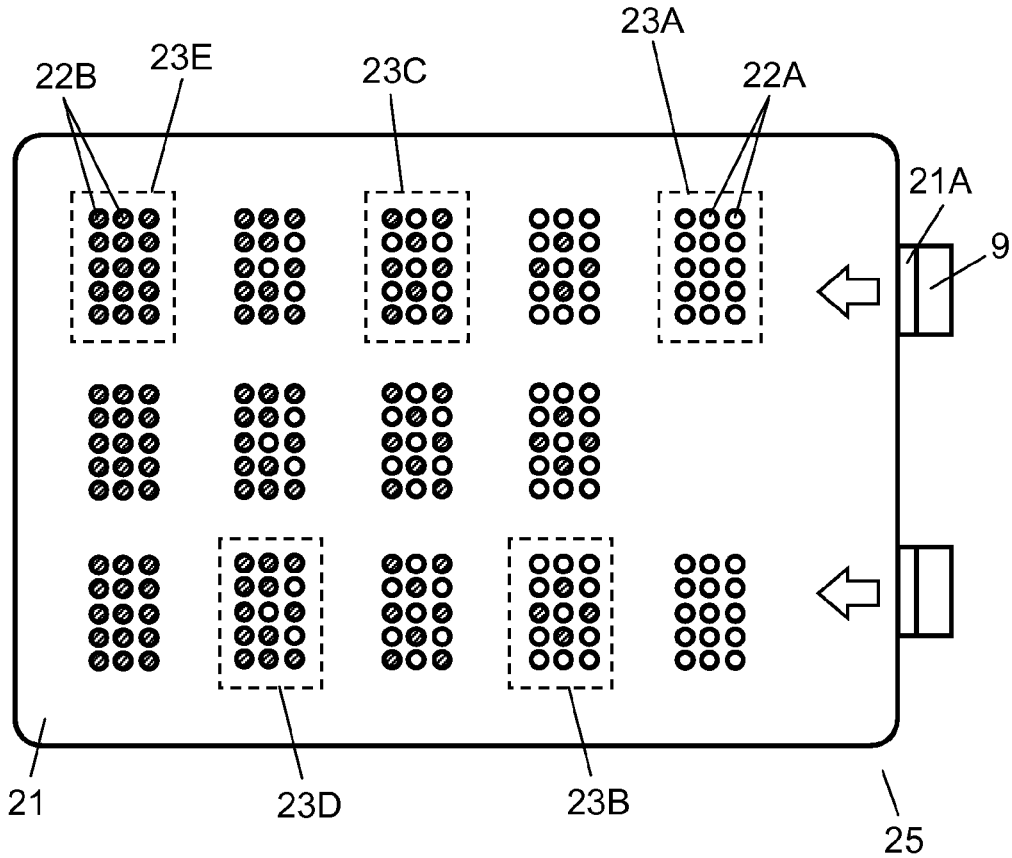
FIG. 6 is a plan view illustrating a state that light-emitting elements are attached to the movable contact unit shown in FIG. 5.
Figure 7:
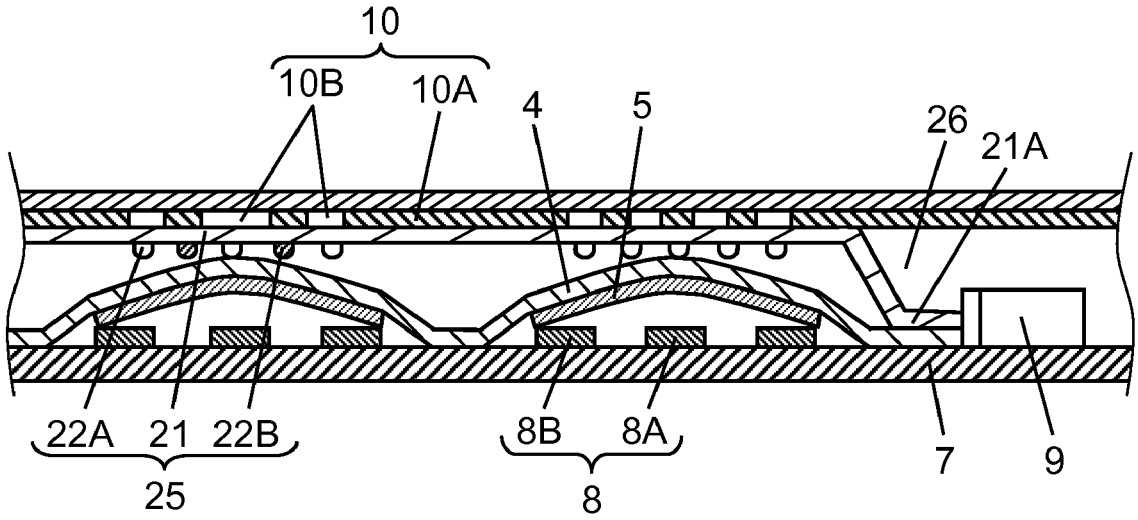
FIG. 7 is a sectional view of a switch employing the movable contact unit shown in FIG. 5.

FIG. 5 is a sectional view of a movable contact unit in the second exemplary embodiment of the present invention. FIG. 6 is a plan view of this movable contact unit to which light-emitting element 9 is attached. FIG. 7 is a sectional view of a switch employing this movable contact unit. The second exemplary embodiment differs from the first exemplary embodiment in that light-guide sheet 25 includes substrate 21, white luminescent protrusion 22A, and blue luminescent protrusion 22B, instead of substrate 11 and luminescent protrusions 12. Other components are the same as those in the first exemplary embodiment.

Light-guide sheet 25 includes substrate 21 and luminescent protrusions 22A and 22B. Film substrate 21 is light-transmissive, and is, for example, transparent. In other words, substrate 21 is made of the same main material as substrate 11 in the first exemplary embodiment, but is not colored with dye or pigment.

Convex and concave light-emitting portions 23A, 23B, 23C, 23D and 23E are formed at predetermined portions on the bottom face of substrate 21. Light-emitting portions 23A, 23B, 23C, 23D, and 23E are provided closer to light-emitting element 9 in this order. For example, light-emitting portion 23A is closer to light-emitting element 9 than light-emitting portion 23B.

Light-emitting portion 23A is formed of white luminescent protrusions 22A, such as white or milky white, same as luminescent protrusions 12 in the first exemplary embodiment. On the other hand, light-emitting portions 23B, 23C, 23D, and 23E are formed of white luminescent protrusions 22A and blue luminescent protrusions 22B. A main constituent of blue luminescent protrusions 22B is acryl, polyester, epoxy, or silicone in which a filler material such as titanium oxide and barium titanate is dispersed. In addition, pigment or dye, such as phthalocyanine, indigo, anthraquinone, and iron blue, is dispersed. In other words, blue luminescent protrusions 22B are colored to a blue tone, which is a complementary color of yellow. Here, "blue tone" is a color tone that absorbs yellow light more than blue light. It absorbs yellow light more than blue light in a luminescent spectral component by light-emitting element 9. The "blue tone" may thus be a color tone that is slightly different from blue. White luminescent protrusions 22A and blue luminescent protrusions 22B are formed in dots typically by printing.

Light-emitting portions 23A may also include a few blue luminescent protrusions 22B in addition to white luminescent protrusion 22A. In other words, light-emitting portion 23A is almost or entirely formed of white luminescent protrusions 22A. The percentage of blue luminescent protrusions 22B increases leftward for light-emitting portions 23B, 23C, 23D, to 23E. Light-emitting portion 23E at the left end is formed mostly of blue luminescent protrusions 22B. In other words, the percentage of blue luminescent protrusions 22B is higher at a point further from end 21A where light-emitting element 9 emits light. Light-guide sheet 25 is formed in this way, and movable contact unit 26 is configured using this light-guide sheet 25.

When the power is supplied to light-emitting element 9 from an electronic circuit of a device, light-emitting element 9 emits light, and this light enters light-guide sheet 25 from a side face at the right end. The entered light disperses and reflects on white luminescent protrusions 22A and blue luminescent protrusions 22B in light-emitting portions 23A, 23B, 23C, 23D, and 23E; and display portions 10B of display sheet 10 are lighted from beneath. As described above, light-emitting portions 23B to 23D include white luminescent protrusions 22A and blue luminescent protrusions 22B. Light-emitting portion 23E is mostly formed of blue luminescent protrusions 22B. Therefore, light-emitting portions 23B to 23E far from light-emitting element 9 also emit white light same as light-emitting portion 23A closest to light-emitting element 9. Accordingly, variations in luminescent colors of light-emitting portions 23A to 23E are eliminated, and thus uniform lighting is achieved.

As shown in FIG. 6, the white light entering light-guide sheet 25 from light-emitting element 9 first reflects on light-emitting portion 23A formed of white luminescent protrusions 22A which is closest to light-emitting element 9, so as to illuminate display portion 10B above it in white. Then, as this entered light propagates leftward through transparent substrate 21, the blue color which has low light-transmittance weakens, and yellow color which has relatively high light-transmittance relatively intensifies. As a result, the entered light becomes yellowish light.

However, the percentage of blue luminescent protrusions 22B increases to the left, namely away from light-emitting element 9, in light-emitting portions 23B to 23D. Therefore, a yellow component in a slightly yellowish white light in the middle, for example, is absorbed by blue luminescent protrusions 22B as the light is reflected on light-emitting portions 23B to 23D. Therefore, the white light is emitted for illuminating display portions 10B over them.

Light-emitting portion 23E at the left end, which is the furthest from light-emitting element 9, is formed mostly of blue luminescent protrusions 22B. Therefore, the light becomes substantially yellowish but many blue luminescent protrusions 22B produce white light.

As described above, the white light can be emitted even at a position far from light-emitting element 9 by forming convex and concave light-emitting portions 23B to 23D with white luminescent protrusions 22A and blue luminescent protrusions 22B. Still more, the white light can be emitted regardless of a distance from light-emitting element 9 by changing percentages of white luminescent protrusions 22A and blue luminescent protrusions 22B corresponding to the distance from light-emitting element 9. In other words, light-emitting portion 23C at the middle of light-guide sheet 25 and light-emitting portion 23E at the left end, which are far from light-emitting element 9, reflect yellow light in white light at the same level as reflection of blue light in white light. The structure in the second exemplary embodiment thus achieves the same effect as that in the first exemplary embodiment.

In this exemplary embodiment, white luminescent protrusions 22A and blue luminescent protrusions 22B are formed on transparent substrate 21. However, the present invention is not limited to this structure. Substrate 11 in the first exemplary embodiment may be used instead of substrate 21. In other words, at least one of the substrate and the luminescent protrusions is colored to a color tone that absorbs yellow light more than blue light.

Furthermore, luminescent protrusions 22A and 22B are used for forming light-emitting portions 23A to 23E in this exemplary embodiment. In other words, luminescent protrusions 22A and 22B are separately provided on substrate 21. However, luminescent protrusions 22A and 22B may be evenly formed on substrate 21, depending on the use. Also in that case, the percentage of blue luminescent protrusions 22B is increased in areas far from light-emitting element 9.

Third Exemplary Embodiment

Figure 8:
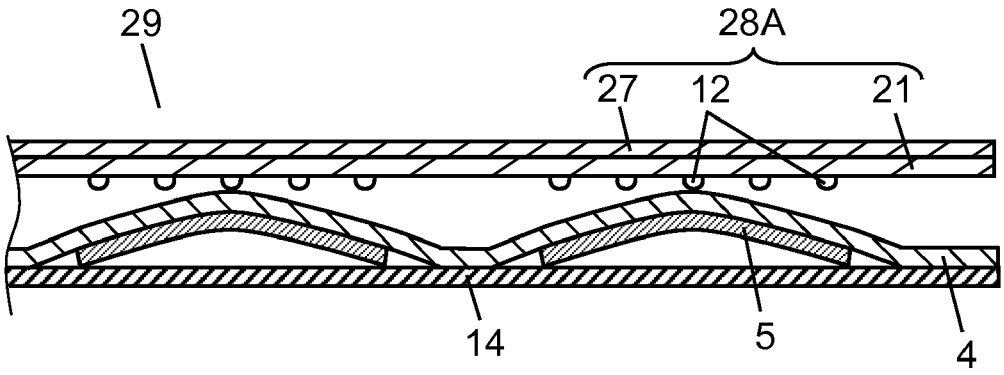
FIG. 8 is a sectional view of a movable contact unit employing a light-guide sheet in accordance with a third exemplary embodiment of the present invention.
Figure 9:
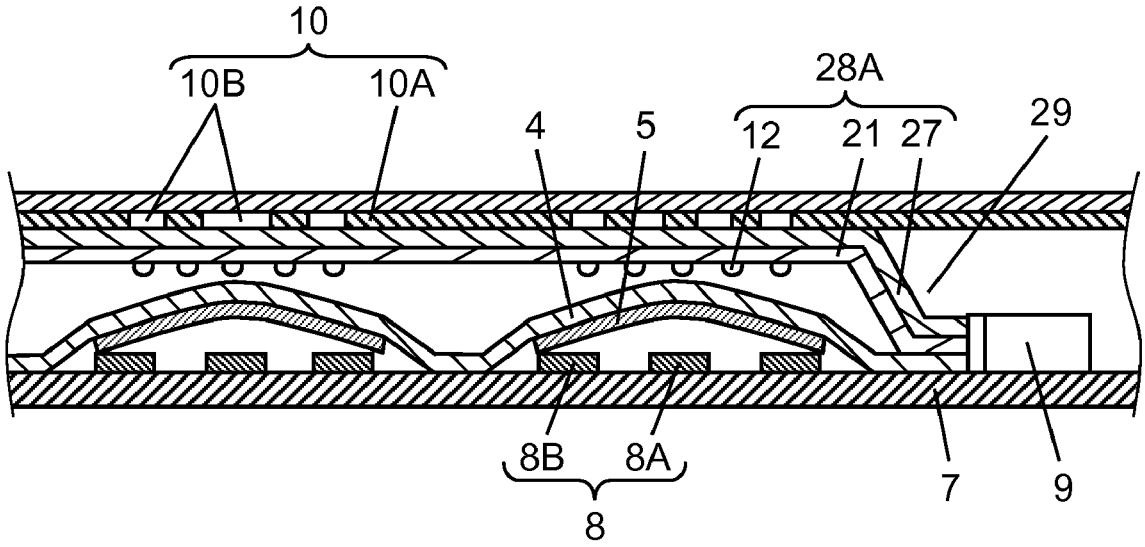
FIG. 9 is a sectional view of a switch employing the movable contact unit shown in FIG. 8.

FIG. 8 is a sectional view of a movable contact unit in the third embodiment of the present invention. FIG. 9 is a sectional view of a switch employing this movable contact. The third exemplary embodiment differs from the first exemplary embodiment in that substrate 21 is used instead of substrate 11, and reflective layer 27 is provided on light-guide sheet 28A. Other components are the same as that in the first exemplary embodiment.

Light-guide sheet 28A includes substrate 21, luminescent protrusions 12, and reflective layer 27. Substrate 21 is the same as that used in the second exemplary embodiment, and luminescent protrusions 12 are the same as those used in the first exemplary embodiment. Accordingly, description of their details is omitted. Movable contact unit 29 employs light-guide sheet 28A.

Reflective layer 27 is formed on the top face of substrate 21 typically by printing. Reflective layer 27 is formed typically of acryl, polyester, epoxy, or silicone in which pigment or dye, such as phthalocyanine, indigo, anthraquinone, and iron blue, is dispersed. In other words, reflective layer 27 is colored to a blue tone, which is a complementary color of yellow. Here, "blue tone" refers to a color tone that absorbs yellow light more than blue light. It absorbs yellow light more than blue light in a luminescent spectral component by light-emitting element 9. The "blue tone" may thus be a color tone slightly different from blue.

When light-emitting element 9 emits light, this light enters light-guide sheet 28A from a side face at the right end. The light is dispersed and reflected on luminescent protrusions 12 so as to light display sheet 10. The light of light-emitting element 9 entering from the right side face propagates through leftward in transparent substrate 21 while being reflected on reflective layer 27 colored to a blue tone.

In other words, in this exemplary embodiment, the white light entering light-guide sheet 28A is reflected on reflective layer 27 colored to a blue tone as the light propagates leftward through transparent substrate 21, and reflective layer 27 absorbs yellow light. This prevents yellowish luminescent color in which blue with low transmittance is weakened and yellow with high transmittance is relatively intensified. Accordingly, luminescent protrusions 12 at points far from light-emitting element 9 emit white light the same as luminescent protrusions 12 near light-emitting element 9. As a result, variations in luminescent colors are suppressed, and display sheet 10 is uniformly lighted. Accordingly, the structure in this exemplary embodiment also achieves the same effect as that in the first exemplary embodiment.

Since reflective layer 27 is configured with a material as described above, not all of the light propagating in substrate 21 is reflected, and thus some light propagates through and passes across reflective layer 27. In other words, some of the light propagating in substrate 21 leaks to reflective layer 27, and the light leaked from substrate 21 to reflective layer 27 partly leaks back to substrate 21. Also, the light in a vertical direction, such as the light from luminescent protrusions 12 and the reflected light from cover sheet 4, passes across reflective layer 27. Therefore, the user can see display portions 10B although reflective layer 27 is provided on the entire face of substrate 21, as shown in FIGS. 8 and 9. Alternatively, reflective layer 27 may not be provided on display portions 10B and their surrounding area.

Figure 10A:
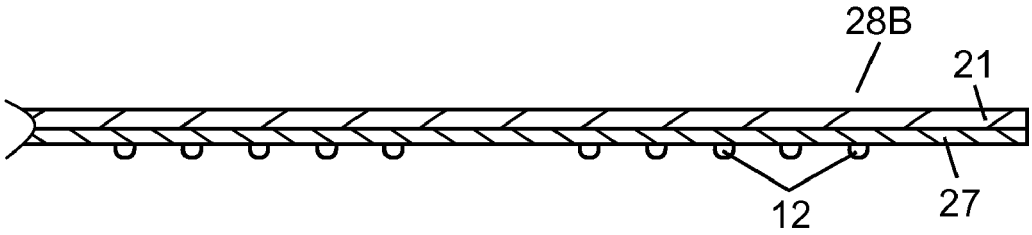
FIGS. 10A and 10B are sectional views of another movable contact unit in accordance with the third exemplary embodiment of the present invention.
Figure 10B:
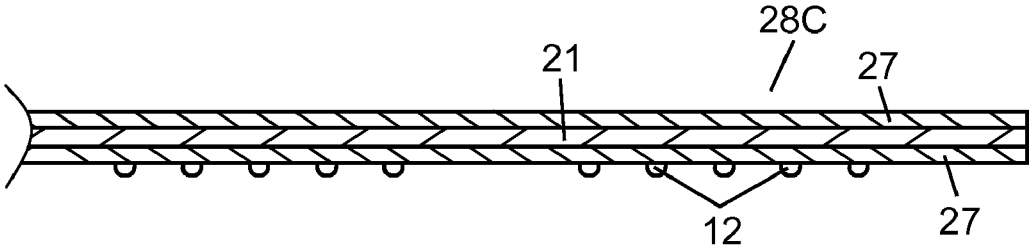
Figure 11:
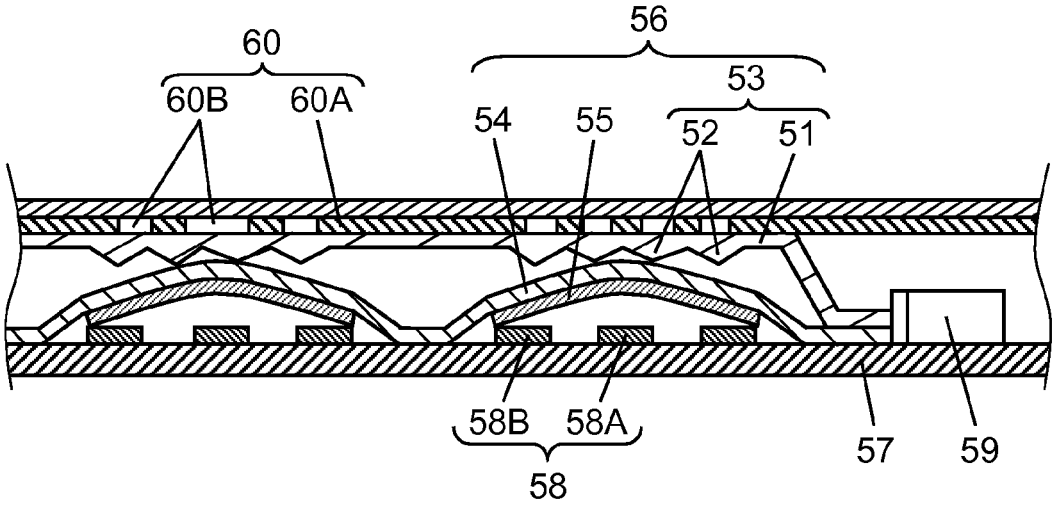
FIG. 11 PRIOR ART
FIG. 11 is a sectional view of a switch to which a conventional light-guide sheet is applied.
Figure 12:
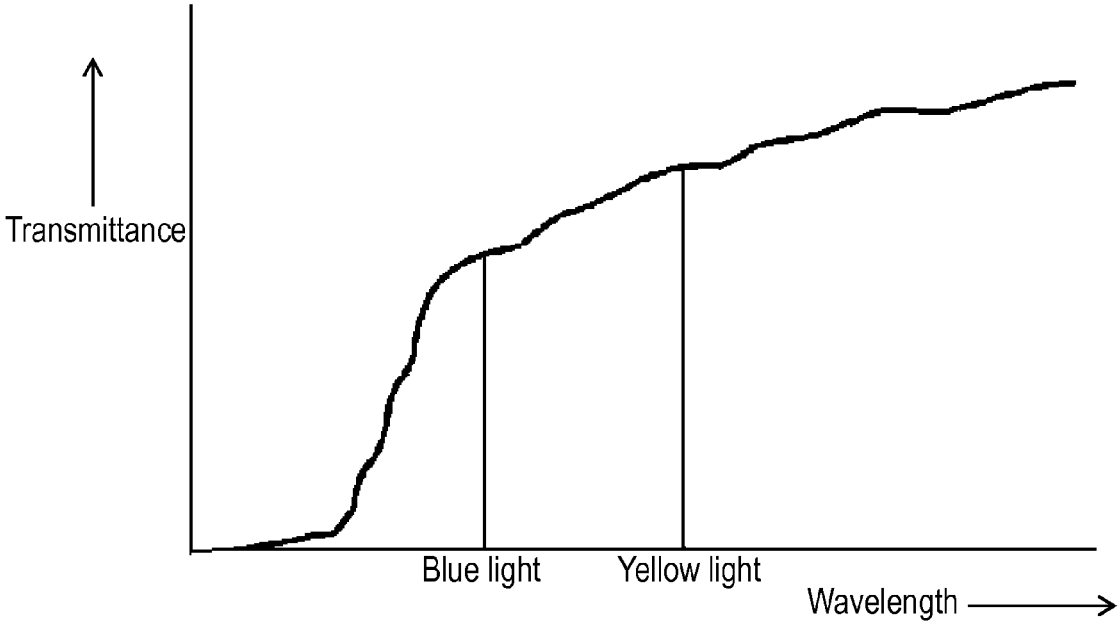
FIG. 12 PRIOR ART
FIG. 12 is a graph illustrating a relationship between a wavelength and transmittance of the light-guide sheet shown in FIG. 11.

The above description refers to light-guide sheet 28A in which reflective layer 27 colored in a blue tone, which is a complementary color of yellow, is formed on the top face of substrate 21. However, the present invention is not limited to this structure. As shown in a sectional view in FIG. 10A, reflective layer 27 may be formed on the bottom face of substrate 21, and luminescent protrusions 12 may be formed on this bottom face in light-guide sheet 28B. Or, as shown in a sectional view in FIG. 10B, reflective layer 27 may be formed on both top and bottom faces of substrate 21 in light-guide sheet 28C. Since some light leaks from substrate 21 to reflective layer 27 so as to reach to protrusions 12, and also the light in a vertical direction passes across reflective layer 27, Any of these structures is applicable to the present invention.

The above description also refers to the structure of forming reflective layer 27 on the top or bottom face of substrate 21 typically by printing. However, the present invention is not limited to this structure. A solution in which aforementioned pigment or dye is dispersed may be applied to the top or bottom face of substrate 21 so as to penetrate dye or pigment into substrate 21 to form reflective layer 27.

Furthermore, transparent substrate 21 and white or milky white luminescent protrusions 12 are used in the description. However, substrate 11 used in the first and second exemplary embodiments may be combined with luminescent protrusions 22A and 22B, and reflective layer 27.

The first to third exemplary embodiments refer to the formation of white luminescent color of light-emitting element 9 by mixing blue light and yellow light. However, the white light may be produced by mixing three light-emitting elements of blue light, green light, and red light. Alternatively, the white light may be produced by applying near-ultra violet light to a fluorescent substance of blue, green, and red. These are also applicable to the present invention.

Furthermore, the first to third exemplary embodiments refer to the structure of forming luminescent protrusions 12 or luminescent protrusions 22A and 22B on the bottom face of substrate 11 or substrate 21 over movable contact 5 by printing. However, the present invention is not limited to this structure. Luminescent protrusions 12, or luminescent protrusions 22A and 22B may be formed on the top face of substrate 11 or substrate 21. In addition, other than printing, attachment, press, molding, and other methods may be used for forming luminescent protrusions 12 and luminescent protrusions 22A and 22B.

Furthermore, the first to third exemplary embodiments refer to the structure of attaching cover sheet 4, to which movable contacts 5 are attached to its bottom face, to the bottom face of light-guide sheet 13, 25, 28A, 28B, or 28C. However, the present invention is not limited to this structure. Movable contacts 5 may be directly attached to the bottom face of light-guide sheet 13, 25, 28A, 28B, or 28C without cover sheet 4. This structure reduces the total number of components, and thus movable contact units 16, 26, and 29 can be simplified at a lower cost.

As described above, the light-guide sheet, and the movable contact unit and switch employing the light-guide sheet eliminate variations in luminescent colors, and provide readily visible and uniform lighting. The present invention is thus efficiently applicable to control panels of a range of electronic devices.

What is claimed is:

1. A light-guide sheet comprising:

a light-transmissive film substrate having an end to receive light of a light-emitting element into the substrate; and a plurality of first luminescent protrusions formed at predetermined points on the substrate, each of the first luminescent protrusions being colored to a color tone that absorbs yellow light more than blue light; and a plurality of second white luminescent protrusions formed at predetermined points on the substrate;

wherein a proportion of the first luminescent protrusions is higher than that of the second luminescent protrusions at a point further from the end of the substrate.

2. A movable contact unit comprising:

a light-guide sheet including a light transmissive film substrate, a plurality of first luminescent protrusions formed at predetermined points on the substrate, the substrate having an end to receive light of a light-emitting element into the substrate, each of the first luminescent protrusions being colored to a color tone that absorbs yellow light more than blue light, a plurality of second white luminescent protrusions formed at predetermined points on the substrate, wherein a proportion of the first luminescent protrusions is higher than that of the second luminescent protrusions at a point further from the end of the substrate; and a dome-like resilient movable contact made of a thin metal sheet, the movable contact being disposed beneath at least one of the first luminescent protrusions and the second luminescent protrusions of the light-guide sheet.

3. A switch comprising:

a light-guide sheet including a light-transmissive film substrate, a plurality of first luminescent protrusions formed at predetermined points on the substrate, the substrate having an end to receive light of a light-emitting element into the substrate, each of the first luminescent protrusions being colored to a color tone that absorbs yellow light more than blue light, a plurality of second white luminescent protrusions formed at predetermined points on the substrate, wherein a proportion of the first luminescent protrusions is higher than that of the second luminescent protrusions at a point further from the end of the substrate;

a dome-like resilient movable contact made of a thin metal sheet, the movable contact being disposed beneath at least one of the first luminescent protrusions and the second luminescent protrusions of the light-guide sheet; and a wiring board having a face on which a central fixed contact, an outer fixed contact surrounding the central fixed contact, and a light-emitting element are provided;

wherein an outer periphery of the movable contact is disposed on the outer fixed contact, a center of the movable contact faces the central fixed contact with a predetermined distance in between, and the light-emitting element is disposed at the end of the substrate.

4. A light-guide sheet comprising:

a light-transmissive film substrate;

a plurality of luminescent protrusions formed at predetermined points on the substrate; and a reflective layer provided on at least one of a top face and a bottom face of the substrate, the reflective layer being colored to a color tone that absorbs yellow light more than blue light, and the reflective layer being configured such that, with light propagating in the substrate, part of the light is reflected by the reflective layer and part of the light passes across the reflective layer.

5. A movable contact unit comprising:

a light guide sheet including a light-transmissive film substrate, a plurality of luminescent protrusions formed at predetermined points on the substrate, and a reflective layer provided on at least one of a top face and a bottom face of the substrate, the reflective layer being colored to a color tone that absorbs yellow light more than blue light, and the reflective layer being configured such that, with light propagating in the substrate, part of the light is reflected by the reflective layer and part of the light passes across the reflective layer; and a dome-like resilient movable contact made of a thin metal sheet, the movable contact being disposed beneath the luminescent protrusions of the light-guide sheet.

6. A switch comprising:

a light-guide sheet including a light-transmissive film substrate, the substrate having an end to receive light of a light-emitting element into the substrate, a plurality of luminescent protrusions formed at predetermined points on the substrate, and a reflective layer provided on at least one of a top face and a bottom face of the substrate, the reflective layer being colored to a color tone that absorbs yellow light more than blue light, and the reflective layer being configured such that, with light propagating in the substrate, part of the light is reflected by the reflective layer and part of the light passes across the reflective layer;

a dome-like resilient movable contact made of a thin metal sheet, the movable contact being disposed beneath the luminescent protrusions of the light-guide sheet; and a wiring board having a face on which a central fixed contact, an outer fixed contact surrounding the central fixed contact, and a light-emitting element are provided;

wherein an outer periphery of the movable contact is placed on the outer fixed contact, a center of the movable contact faces the central fixed contact with a predetermined distance in between, and the light-emitting element is disposed at the end of the substrate.

7. A light-guide sheet comprising:

a light-transmissive film substrate formed of one of polyurethane, silicone, and polystyrene; and a plurality of luminescent protrusions formed at predetermined points on the substrate;

wherein the light-transmissive film substrate is colored to a color tone that absorbs yellow light more than blue light so that transmittance of yellow light is substantially equal to transmittance of blue light in the substrate.

8. A movable contact unit comprising:

a light-guide sheet including a light transmissive film substrate formed of one of polyurethane, silicone, and polystyrene, and a plurality of luminescent protrusions formed at predetermined points on the substrate; and a dome-like resilient movable contact made of a thin metal sheet, the movable contact being disposed beneath the luminescent protrusions of the light-guide sheet;

wherein the light-transmissive film substrate is colored to a color tone that absorbs yellow light more than blue light so that transmittance of yellow light is substantially equal to transmittance of blue light in the substrate.

9. A switch comprising:

a light-guide sheet including a light-transmissive film substrate formed of one of polyurethane, silicone, and polystyrene and having an end to receive light of a light-emitting element into the substrate, and a plurality of luminescent protrusions formed at predetermined points on the substrate;

a dome-like resilient movable contact made of a thin metal sheet, the movable contact being disposed beneath the luminescent protrusions of the light-guide sheet; and a wiring board having a face on which a central fixed contact, an outer fixed contact surrounding the central fixed contact, and the light-emitting element are provided;

wherein an outer periphery of the movable contact is disposed on the outer fixed contact, a center of the movable contact faces the central fixed contact with a predetermined distance in between, and the light-emitting element is disposed at the end of the substrate;

wherein the light-transmissive film substrate is colored to a color tone that absorbs yellow light more than blue light so that transmittance of yellow light is substantially equal to transmittance of blue light in the substrate.

10. A light-guide sheet comprising:

a light-transmissive film substrate having an elastic modulus of at least 1 MPa and at most 1000 MPa; and a plurality of luminescent protrusions formed at predetermined points on the substrate;

wherein the light-transmissive film substrate is colored to a color tone that absorbs yellow light more than blue light so that transmittance of yellow light is substantially equal to transmittance of blue light in the substrate.

11. The light-guide sheet according to 10, wherein the elastic modulus of the light-transmissive film substrate is at least 1 MPa and at most 200 MPa.

12. The light-guide sheet according to 10, wherein the elastic modulus of the light-transmissive film substrate is at least 1 MPa and at most 50 MPa.

13. A movable contact unit comprising:

a light-guide sheet including a light transmissive film substrate having an elastic modulus of at least 1 MPa and at most 1000 MPa, and a plurality of luminescent protrusions formed at predetermined points on the substrate; and a dome-like resilient movable contact made of a thin metal sheet, the movable contact being disposed beneath the luminescent protrusions of the light-guide sheet;

wherein the light-transmissive film substrate is colored to a color tone that absorbs yellow light more than blue light so that transmittance of yellow light is substantially equal to transmittance of blue light in the substrate.

14. A switch comprising:

a light-guide sheet including a light-transmissive film substrate having an elastic modulus of at least 1 MPa and at most 1000 MPa and an end to receive light of a light-emitting element into the substrate, and a plurality of luminescent protrusions formed at predetermined points on the substrate;

a dome-like resilient movable contact made of a thin metal sheet, the movable contact being disposed beneath the luminescent protrusions of the light-guide sheet; and a wiring board having a face on which a central fixed contact, an outer fixed contact surrounding the central fixed contact, and the light-emitting element are provided;

wherein an outer periphery of the movable contact is disposed on the outer fixed contact, a center of the movable contact faces the central fixed contact with a predetermined distance in between, and the light-emitting element is disposed at the end of the substrate;

wherein the light-transmissive film substrate is colored to a color tone that absorbs yellow light more than blue light so that transmittance of yellow light is substantially equal to transmittance of blue light in the substrate.

15. A switch comprising:

a light-guide sheet including a light-transmissive film substrate, the substrate having an end to receive light of a light-emitting element into the substrate, and a plurality of luminescent protrusions formed at predetermined points on the substrate;

a dome-like resilient movable contact made of a thin metal sheet, the movable contact being disposed beneath the luminescent protrusions of the light-guide sheet; and a wiring board having a face on which a central fixed contact, an outer fixed contact surrounding the central fixed contact, and the light-emitting element are provided; and wherein an outer periphery of the movable contact is disposed on the outer fixed contact, a center of the movable contact faces the central fixed contact with a predetermined distance in between, and the light-emitting element is disposed at the end of the substrate;

wherein the light-emitting element is operable to emit a white light by mixing blue light and yellow light, wherein the light-transmissive film substrate is colored to a color tone that absorbs yellow light more than blue light so that transmittance of the yellow light in the white light emitted by the light-emitting element is substantially equal to transmittance of the blue light in the white light emitted by the light-emitting element in the substrate.

* * * * *